US006622519B1

(12) United States Patent
Mathias et al.

(10) Patent No.: US 6,622,519 B1
(45) Date of Patent: Sep. 23, 2003

(54) PROCESS FOR COOLING A PRODUCT IN A HEAT EXCHANGER EMPLOYING MICROCHANNELS FOR THE FLOW OF REFRIGERANT AND PRODUCT

(75) Inventors: James A. Mathias, Columbus, OH (US); Ravi Arora, Dublin, OH (US); Wayne W. Simmons, Dublin, OH (US); Jeffrey S. McDaniel, Columbus, OH (US); Anna Lee Tonkovich, Marysville, OH (US); William A. Krause, Houston, TX (US); Laura J. Silva, Dublin, OH (US)

(73) Assignee: Velocys, Inc., Plain City, OH (US)

( * ) Notice: Subject to any disclaimer, the term of this patent is extended or adjusted under 35 U.S.C. 154(b) by 0 days.

(21) Appl. No.: 10/219,990

(22) Filed: Aug. 15, 2002

(51) Int. Cl.[7] ..... F25J 1/00
(52) U.S. Cl. ..... 62/611; 62/613
(58) Field of Search ..... 62/611, 613; 165/185

(56) References Cited

U.S. PATENT DOCUMENTS

| | | | | |
|---|---|---|---|---|
| 3,176,763 | A | 4/1965 | Frohlich | |
| 4,128,409 | A | 12/1978 | Bennett | 62/26 |
| 4,183,403 | A | 1/1980 | Nicholson | 165/166 |
| 4,386,505 | A | 6/1983 | Little | 62/514 R |

(List continued on next page.)

FOREIGN PATENT DOCUMENTS

| | | | |
|---|---|---|---|
| EP | 0 885 086 | B1 | 2/1997 |
| EP | 0 904 608 | B1 | 12/2001 |
| WO | 97/32687 | | 9/1997 |
| WO | 98/55812 | | 10/1998 |
| WO | 00/06295 | | 2/2000 |
| WO | 00/76651 | A1 | 12/2000 |
| WO | 01/10773 | A1 | 2/2001 |
| WO | 01/12312 | A2 | 2/2001 |
| WO | 01/12753 | A1 | 2/2001 |
| WO | 01/54807 | A1 | 8/2001 |
| WO | 01/69154 | A1 | 9/2001 |
| WO | 01/95237 | A2 | 12/2001 |
| WO | 02/00547 | A1 | 3/2002 |
| WO | 02/02220 | A1 | 10/2002 |

OTHER PUBLICATIONS

Finn et al.; "Design, Equipment Changes Make Possible High $C_3$ Recovery"; *Oil & Gas Journal*; Jan. 3, 2000; pp. 37–44.

Finn et al.; "Developments in Natural Gas Liquefaction"; *Hydrocarbon Processing*; Apr. 1999; pp. 47–59.

*Hydrocarbon Processing*; May 2002; "LNG–Pro"; p. 83.

*Hydrocarbon Processing*; May 2002; "NGL Recovery"; p. 83.

*Hydrocarbon Processing*; May 2002; LNG End Flash (Maxi LNG Production); p. 82.

(List continued on next page.)

*Primary Examiner*—William C. Doerrler
(74) *Attorney, Agent, or Firm*—Renner, Otto, Boisselle & Sklar, LLP

(57) ABSTRACT

This invention relates to a process for cooling a product in a heat exchanger, the process comprising: flowing a refrigerant through a set of first microchannels in the heat exchanger; flowing a refrigerant through a set of second microchannels in the heat exchanger, the refrigerant flowing through the set of second microchannels being at a lower temperature, a lower pressure or both a lower temperature and a lower pressure than the refrigerant flowing through the set of first microchannels; and flowing a product through a set of third microchannels in the heat exchanger, the product exiting the set of third microchannels having a cooler temperature than the product entering the set of third microchannels. This process is suitable for liquefying gaseous products including natural gas.

37 Claims, 4 Drawing Sheets

U.S. PATENT DOCUMENTS

| | | | | | |
|---|---|---|---|---|---|
| 4,392,362 | A | | 7/1983 | Little | 62/514 R |
| 4,434,845 | A | | 3/1984 | Steeb | |
| 4,516,632 | A | | 5/1985 | Swift et al. | 165/167 |
| 4,690,702 | A | | 9/1987 | Paradowski et al. | 62/23 |
| 5,058,665 | A | | 10/1991 | Harada | 165/164 |
| 5,114,450 | A | | 5/1992 | Paradowski et al. | 62/24 |
| 5,271,459 | A | | 12/1993 | Daschmann | 165/166 |
| 5,309,637 | A | | 5/1994 | Moriarty | 29/890.054 |
| 5,317,805 | A | | 6/1994 | Hoopman et al. | 29/890.03 |
| 5,324,452 | A | | 6/1994 | Allam et al. | 252/373 |
| 5,518,697 | A | | 5/1996 | Dalla Betta et al. | 422/173 |
| 5,590,538 | A | * | 1/1997 | Hsu et al. | 62/51.2 |
| 5,611,214 | A | | 3/1997 | Wegeng et al. | 62/498 |
| 5,674,301 | A | | 10/1997 | Sakai et al. | 48/61 |
| 5,689,966 | A | | 11/1997 | Zess et al. | 62/238.6 |
| 5,727,618 | A | | 3/1998 | Mundinger et al. | 165/80.4 |
| 5,775,114 | A | | 7/1998 | Ji | 62/121 |
| 5,791,160 | A | * | 8/1998 | Mandler et al. | 62/611 |
| 5,811,062 | A | | 9/1998 | Wegeng et al. | 422/129 |
| 5,858,314 | A | | 1/1999 | Hsu et al. | 422/211 |
| 5,911,273 | A | | 6/1999 | Brenner et al. | 165/167 |
| 5,927,396 | A | | 7/1999 | Damsohn et al. | 165/167 |
| 6,056,932 | A | | 5/2000 | von Hippel et al. | 423/376 |
| 6,105,388 | A | * | 8/2000 | Acharya et al. | 62/612 |
| 6,105,389 | A | * | 8/2000 | Paradowski et al. | 62/613 |
| 6,126,723 | A | | 10/2000 | Drost et al. | 96/4 |
| 6,129,973 | A | | 10/2000 | Martin et al. | 428/166 |
| 6,159,358 | A | | 12/2000 | Mulvaney, III et al. | 208/46 |
| 6,167,952 | B1 | | 1/2001 | Downing | 165/167 |
| 6,192,596 | B1 | | 2/2001 | Bennett et al. | 34/76 |
| 6,193,501 | B1 | | 2/2001 | Masel et al. | 431/170 |
| 6,200,536 | B1 | | 3/2001 | Tonkovich et al. | 422/177 |
| 6,203,587 | B1 | | 3/2001 | Lesieur et al. | 48/61 |
| 6,216,343 | B1 | | 4/2001 | Leland et al. | 29/890.032 |
| 6,220,497 | B1 | | 4/2001 | Benz et al. | 228/118 |
| 6,228,341 | B1 | | 5/2001 | Hebert et al. | 423/352 |
| 6,230,408 | B1 | | 5/2001 | Ehrfeld et al. | 29/890.039 |
| 6,241,875 | B1 | | 6/2001 | Gough | 208/106 |
| 6,274,101 | B1 | | 8/2001 | Sechrist | 422/198 |
| 6,294,138 | B1 | | 9/2001 | von Hippel et al. | 422/200 |
| 6,295,833 | B1 | * | 10/2001 | Hoffart et al. | 62/613 |
| 6,298,688 | B1 | * | 10/2001 | Brostow et al. | 62/613 |
| 6,313,393 | B1 | | 11/2001 | Drost | 136/201 |
| 6,318,913 | B2 | | 11/2001 | Wakamiya et al. | 396/576 |
| 6,352,577 | B1 | | 3/2002 | Martin et al. | 96/4 |
| 6,364,007 | B1 | | 4/2002 | Fischer | 165/166 |
| 6,381,846 | B2 | | 5/2002 | Insley et al. | 29/890.039 |
| 6,389,696 | B1 | | 5/2002 | Heil et al. | 29/890.039 |
| 6,412,302 | B1 | * | 7/2002 | Foglietta | 62/611 |
| 6,415,860 | B1 | | 7/2002 | Kelly et al. | 165/748 |
| 6,427,483 | B1 | * | 8/2002 | Rashad et al. | 62/613 |
| 6,497,856 | B1 | | 12/2002 | Lomax, Jr. et al. | 423/651 |
| 2001/0024629 | A1 | | 9/2001 | Brauchle et al. | 422/198 |
| 2001/0025705 | A1 | | 10/2001 | Nash et al. | 165/167 |
| 2001/0030041 | A1 | | 10/2001 | Boneberg et al. | 165/166 |
| 2001/0051662 | A1 | | 12/2001 | Arcuri et al. | 518/704 |
| 2002/0029871 | A1 | | 3/2002 | Kern | 165/151 |
| 2002/0031455 | A1 | | 3/2002 | Hippel et al. | 422/173 |
| 2002/0051741 | A1 | | 5/2002 | Abe et al. | 422/199 |
| 2002/0071797 | A1 | | 6/2002 | Loffler et al. | 422/190 |
| 2002/0081473 | A1 | | 6/2002 | Hanai et al. | 429/26 |
| 2002/0106539 | A1 | | 8/2002 | Chung et al. | 429/19 |
| 2002/0131907 | A1 | | 9/2002 | Iwasaki | 422/110 |

OTHER PUBLICATIONS

*Hydrocarbon Processing*; May 2002; "LNG Plants"; p. 82.
*Hydrocarbon Processing*; May 2002; Cryomax DCP (Dual–Column Propane Recovery); p. 81.
*Hydrocarbon Processing*; May 2002; "Liquefin"; p. 81.
*Hydrocarbon Processing*; May 2002; Prico (LNG): p. 87.
*Hydrocarbon Processing*; May 2002; "Separex Membrane Systems"; p. 87.
TeGrotenhuis et al.; "Optimizing Microchannel Reactors by Trading–Off Equilibrium and Reaction Kinetics through Temperature Management"; International Conference on Microreaction Technology; Mar. 10–14, 2002.
Srinivasan et al.; "Micromachined Reactors for Catalytic Partial Oxidation Reactions"; *AIChE Journal*; Nov. 1997; vol. 43, No. 11.
TeGrotenhuis et al.; "Optimizing Microchannel Reactors by Trading–Off Equilibrium and Reaction Kinetics through Temperature Management"; International Conference on Microreaction Technology; Mar. 10–14, 2002.
Smith, Eric M.; Thermal Design of Heat Exchangers. A Numerical Approach; 1997; Wiley; New York, pp. 279–288.
M. Matlosz et al.; Microreaction Technology; Proceedings of the Fifth International Conference on Microreaction Technology; Oct. 2001; Springer–Verlag.
Smith, Eric M.; Thermal Design of Heat Exchangers; A Numerical Approach; 1997; Wiley, New York.
Pettersen et al.; Development of Compact Heat Exchangers for $Co_2$ Air–Conditioning Systems; vol. 21, No. 3; pp. 180–193; 1998; Great Britain.
Wadekar, V. V.; Compact Heat Exchangers; A Che's Guide to Ches; American Institute of Chemical Engineers; Dec. 2000; pp. 39–40; United States.
Rostami, A. A., et al.; Flow and Heat Transfer for Gas Flowing in Microchannels: A Review; Heat and Mass Transfer 38; 2002; pp. 359–367; Springer–Veriag.
Wegeng, R. S. et al.; Compact Fuel Processors for Fuel Cell Powdered Automobiles Based On Microchannel Technology; Fuel Cells Bulleting No. 28; pp. 8–13.
Kays, W. M.; Compact Heat Exchangers, Third Edition; 1984; Reprint Edition 1998 With Corrections; Kreiger Publishing Co.; Malabar, Florida.

* cited by examiner

PROCESS FOR COOLING A PRODUCT IN A HEAT EXCHANGER EMPLOYING MICROCHANNELS FOR THE FLOW OF REFRIGERANT AND PRODUCT

CROSS-REFERENCE TO RELATED APPLICATIONS

The present application is related to the following commonly-assigned applications filed concurrently herewith on Aug. 15, 2002: "Integrated Combustion Reactors and Methods of Conducting Simultaneous Endothermic and Exothermic Reaction," Ser. No. 10/222,196, "Multi-Stream Microchannel Device," Ser. No. 10/222,604; and "Process for Conducting an Equilibrium Limited Chemical Reaction in a Single Stage Process Channel," Ser. No. 10/219,956. These applications are incorporated herein by reference.

TECHNICAL FIELD

This invention relates to a process for cooling a product in a heat exchanger employing microchannels for the flow of refrigerant and product through the heat exchanger. The process is suitable for liquefying natural gas.

BACKGROUND OF THE INVENTION

Current commercial cryogenic processes for making liquefied natural gas (LNG) include the steps of compressing a refrigerant and flowing it through a spiral wound or brazed aluminum heat exchanger. In the heat exchanger the refrigerant exchanges heat with the natural gas and liquefies the natural gas. These heat exchangers are designed to provide very close temperature approaches between the refrigerant and natural gas streams that are exchanging heat. Increasing the thermal efficiency of these heat exchangers through changes in design or materials of construction typically results in increasing the capital cost of the heat exchanger, increasing the pressure drop for the refrigerant flowing through the heat exchanger, or both. Increasing the pressure drop results in increased compressor requirements. The compressor service required for these processes comprises a significant portion of the capital and operating cost of these processes. The problem therefor is to provide a process that results in a reduction in the pressure drop for the refrigerant flowing through the heat exchanger. This would improve the productivity and economics of the process. The present invention provides a solution to this problem.

Due to the large capital cost of cryogenic liquefaction, LNG plants are being built with ever-larger capacities in order to meet project economic targets through economies of scale. This need for economies of scale has resulted in increases in the size of single-train LNG processes. Currently, the size of a single-train LNG process with one compressor is limited by the maximum size of the compressors that are available. The problem therefor is to reduce the compressor requirements for these processes in order to increase the maximum size for the LNG process that is possible. This invention provides a solution to this problem.

Aluminum is typically used as a material of construction in conventional cryogenic heat exchangers. Aluminum minimizes heat transfer resistance due to the fact that it is a high thermal conductive material. However, since it is a high thermal conductive material aluminum tends to decrease the effectiveness of the heat exchangers due to axial conduction. This limits the ability to shorten the length of these heat exchangers and thereby reduce the overall pressure drop in them. An advantage of the present invention is that it is not necessary to use high thermal conductive materials such as aluminum in constructing the heat exchanger used with the inventive process.

SUMMARY OF THE INVENTION

This invention relates to a process for cooling a product in a heat exchanger, the process comprising: flowing a refrigerant through a set of first microchannels in the heat exchanger; flowing a refrigerant through a set of second microchannels in the heat exchanger, the refrigerant flowing through the set of second microchannels being at a lower temperature, a lower pressure or both a lower temperature and a lower pressure than the refrigerant flowing through the set of first microchannels; and flowing a product through a set of third microchannels in the heat exchanger, the product exiting the set of third microchannels having a cooler temperature than the product entering the set of third microchannels.

In one embodiment, the inventive process is operated using non-turbulent flow for the refrigerant flowing through the sets of first and/or second microchannels. Also, the microchannels may be relatively short. This provides for relatively low pressure drops as the refrigerant flows through the microchannels. These relatively low pressure drops reduce the power requirements for compressors used with such processes. For example, in one embodiment of the invention, a reduction in compression ratio of about 18% may be achieved for the inventive process used in making liquefied natural gas as compared to a comparable process not using microchannels for the flow of refrigerant in the heat exchanger.

Another advantage of the inventive process is that the use of microchannels in the heat exchanger decreases thermal diffusion lengths substantially as compared to prior art methods not using microchannels. This allows for substantially greater heat transfer per unit volume than is achieved with prior art heat exchange techniques.

BRIEF DESCRIPTION OF THE DRAWINGS

In the annexed drawings, like parts and features have like designations.

DETAILED DESCRIPTION OF THE INVENTION

The term "microchannel" refers to a channel having at least one internal dimension of width or height of up to about 2 millimeters (mm), and in one embodiment from about 0.05 to about 2 mm, and in one embodiment from about 0.1 to about 1.5 mm, and in one embodiment about 0.2 to about 1 mm, and in one embodiment about 0.3 to about 0.7 mm, and in one embodiment about 0.4 to about 0.6 mm.

The term "non-turbulent" refers to the flow of a fluid through a channel that is laminar or in transition, and in one embodiment is laminar. The fluid may be a liquid, a gas, or a mixture thereof. The Reynolds Number for the flow of the fluid through the channel may be up to about 4000, and in one embodiment up to about 3000, and in one embodiment up to about 2500, and in one embodiment up to about 2300, and in one embodiment up to about 2000, and in one embodiment up to about 1800, and in one embodiment in the range of about 100to 2300, and in one embodiment about 300 to about 1800. The Reynolds Number used herein is calculated using the hydraulic diameter which is based on the actual shape of the microchannel being used.

The refrigerant may be any refrigerant suitable for use in a vapor compression refrigeration system. These include nitrogen, ammonia, carbon dioxide, organic compounds containing 1 to about 5 carbon atoms per molecule such as methylenechloride, the fluoro-chloro-methanes (e.g., dichlordiflouromethane), hydrocarbons containing 1 to about 5 carbon atoms per molecule (e.g., methane, ethane, ethylene, propanes, butanes, pentanes, etc.), or a mixture of two or more thereof. The hydrocarbons may contain trace amounts of $C_6$ hydrocarbons. In one embodiment, the hydrocarbons are derived from the fractionation of natural gas.

The product to be cooled may be any fluid product. These include liquid products as well as gaseous products, including gaseous products requiring liquefication. The products that may be cooled or liquefied with this process include carbon dioxide, argon, nitrogen, helium, organic compounds containing 1 to about 5 carbon atoms including hydrocarbons containing 1 to about 5 carbon atoms (e.g., methane, ethane, ethylene, propane, isopropane, butene, butane, isobutane, isopentane, etc.), and the like. In one embodiment, the product is natural gas which is liquefied with the inventive process.

Figure 1:
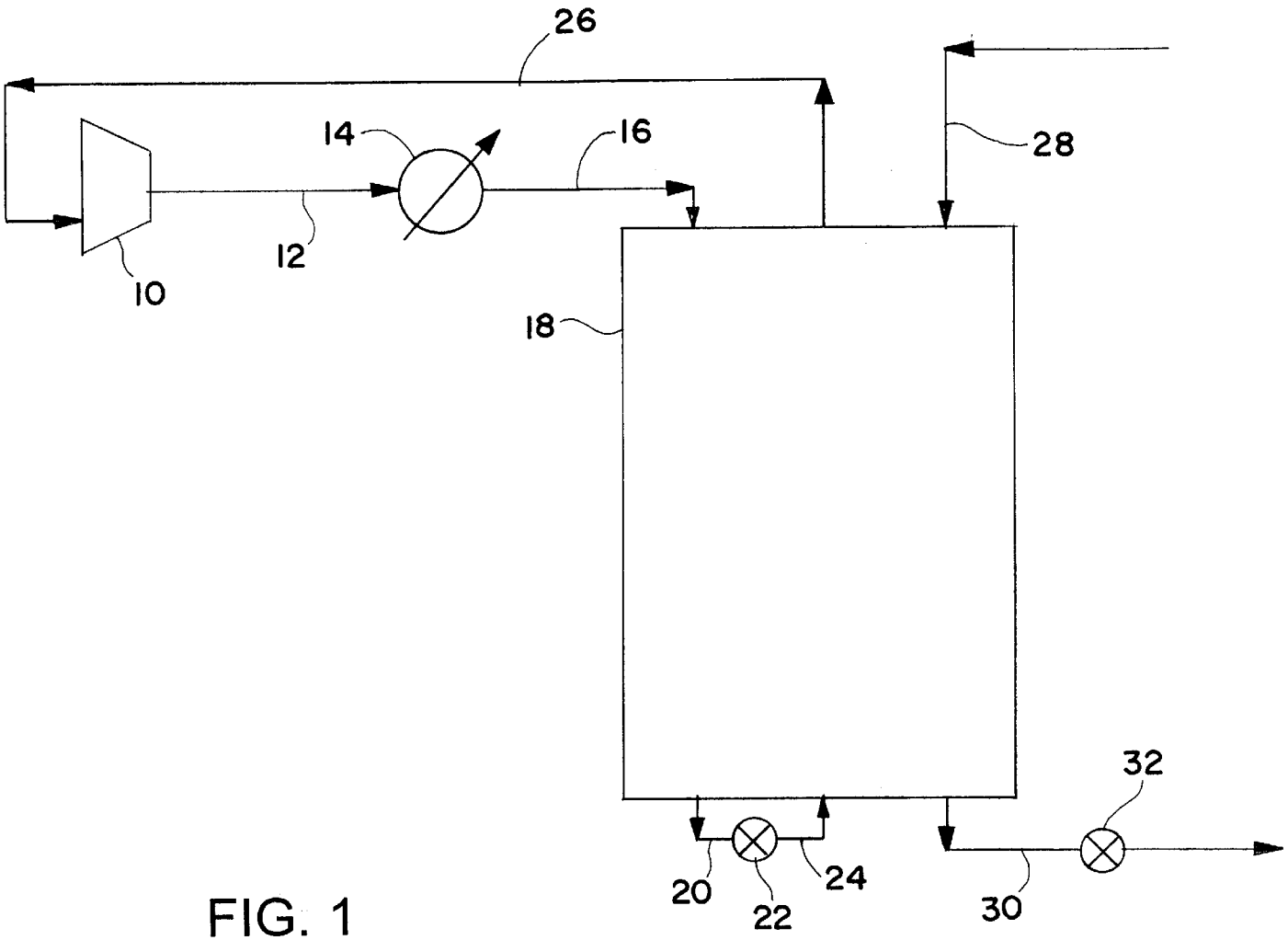
FIG. 1 is a flow sheet illustrating the inventive process in a particular form.

The inventive process will now be described with reference to FIG. 1. Referring to FIG. 1, a gaseous refrigerant is compressed in compressor 10. The compressed refrigerant flows from compressor 10 through line 12 to condenser 14.

In condenser 14 the refrigerant is partially condensed. At this point the refrigerant typically is in the form of a mixture of vapor and liquid. The refrigerant flows from condenser 14 through line 16 to a set of first microchannels in heat exchanger 18. The refrigerant flows through the set of first microchannels in heat exchanger 18 and exits the heat exchanger through line 20. The refrigerant flowing through the set of first microchannels may be at a pressure of up to about 1000 pounds per square inch gage (psig),and in one embodiment in the range of about 200 to about 1000 psig, and may be characterized as a high pressure refrigerant. Upon exiting the set of first microchannels the refrigerant is typically in the form of a liquid. The refrigerant then flows through expansion device 22 where the pressure and/or temperature of the refrigerant are reduced. At this point the refrigerant is typically in form of a mixture of vapor and liquid. From expansion device 22 the refrigerant flows through line 24 to a set of second microchannels in heat exchanger 18. The refrigerant flows through the set of second microchannels in heat exchanger 18 where it is warmed and then exits heat exchanger 18 through line 26. The refrigerant flowing through the set of second microchannels may be at a pressure in the range of up to about 100 psig and may be characterized as a low pressure refrigerant. Upon exiting the second set of microchannels the refrigerant is typically in the form of a vapor. The refrigerant is then returned to compressor 10 through line 26 where the refrigeration cycle starts again.

The ratio of the pressure of the high pressure refrigerant to the pressure of the low pressure refrigerant may be about 10:1. The difference in pressure between the high pressure refrigerant and the low pressure refrigerant may be at least about 100 psi, and in one embodiment at least about 150 psi; and in one embodiment at least about 200 psi, and in one embodiment at least about 250 psi.

The product to be cooled or liquified enters heat exchanger 18 through line 28 and flows through a set of third microchannels in heat exchanger 18. In heat exchanger 18, the set of first microchannels exchange heat with the set of second microchannels, and the set of second microchannels exchange heat with the set of third microchannels. The product is cooled or liquefied and exits heat exchanger 18 through line 30 and valve 32.

The compressor 10 may be of any size and design. However, an advantage of the inventive process is that due to reduced pressure drops that are achieved with the inventive process for the refrigerant flowing through the microchannels, the power requirements for the compressor are reduced. The refrigerant may be compressed in compressor 10 to a pressure of up to about 1000 psig, and in one embodiment about 200 to about 1000 psig, and in one embodiment about 200 to about 600 psig, and in one embodiment about 200 to about 400 psig. The temperature of the compressed refrigerant may be in the range of about 50 to about 500° C., and in one embodiment about 100 to about 200° C. In one embodiment, the refrigerant is compressed to a pressure of about 331.3 psig and the temperature is about 153° C.

The refrigerant may be partially condensed in condenser 14. The condenser may be any conventional size and design. The partially condensed refrigerant may be at a pressure of up to about 1000 psig, and in one embodiment about 200 to about 1000 psig, and in one embodiment about 200 to about 600 psig, and in one embodiment about 200 to about 400 psig; and a temperature of about 0 to about 100° C., and in one embodiment about 0 to about 50° C. In one embodiment, the pressure is about 323.3 psig, and the temperature is about 29.4° C.

Figure 2:
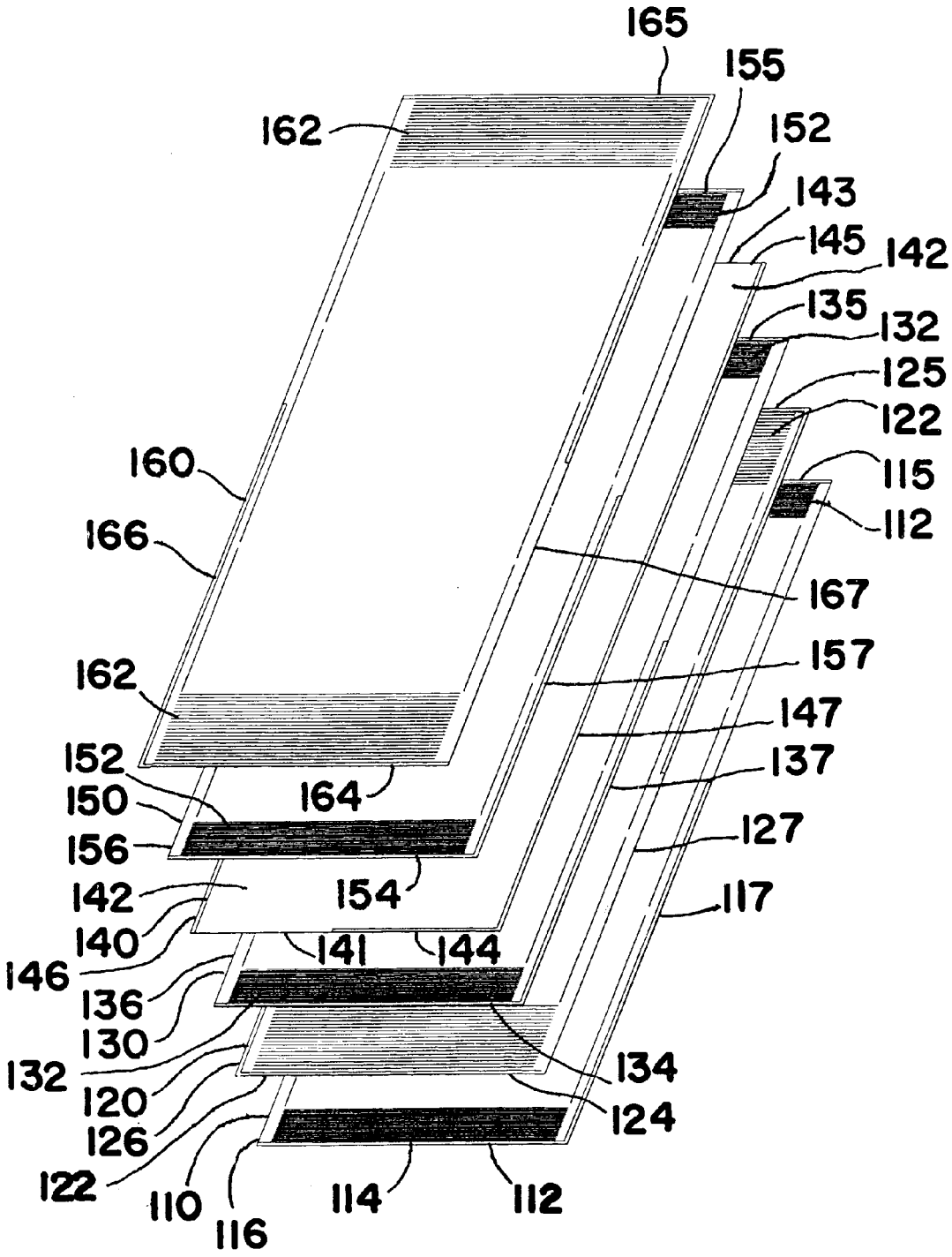
FIG. 2 is a schematic illustration showing an exploded view of one embodiment of a repeating unit of microchannel layers that may be used in a heat exchanger employed with the inventive process.

The heat exchanger 18 contains layers of microchannels corresponding to the sets of first, second and third microchannels. The layers may be aligned one above another in any desired sequence. This is illustrated in FIG. 2 which shows one sequence of layers that may be used. Referring to FIG. 2, layers of microchannels are stacked one above another to provide a repeating unit 100 of microchannel layers which is comprised of microchannel layers 110,120, 130,140, 150 and 160. Microchannels layers 120 and 160 correspond to the set of first microchannels which is provided for the flow of the high pressure refrigerant. Microchannel layers 110, 130 and 150 correspond to the set of second microchannels which is provided for the flow of the low pressure refrigerant. Microchannel layer 140 corresponds to the set of third microchannels which is provided for the flow of the product to be cooled or liquefied. Microchannel layer 110 contains a plurality of second microchannels 112 arranged in parallel and extending along the length of microchannel layer 110 from end 114 to end 115, each microchannel 112 extending along the width of microchannel layer 110 from one end 116 to the other end 117 of microchannel layer 110. Microchannel layer 120 contains a plurality of first microchannels 122 arranged in parallel and extending along the length of microchannel layer 120 from end 124 to end 125, each microchannel 122 extending along the width of microchannel layer 120 from one end 126 to the other end 127 of microchannel layer 120.

Microchannel layer 130 contains a plurality of second microchannels 132 arranged in parallel and extending along the length of microchannel layer 130 from end 134 to end 135, each microchannel 132 extending along the width of microchannel layer 130 from one end 136 to the other end 137 of microchannel layer 130. Microchannel layer 140 contains a single third microchannel 142 which extends along the length of microchannel layer 140 from end 144 to end 145, and along the width of microchannel layer 140 from one end 146 to the other end 147 of microchannel layer 140. Microchannel layer 150 contains a plurality of second microchannels 152 arranged in parallel and extending along the length of microchannel layer 150 from end 154 to end 155, each microchannel 152 extending along the width of microchannel layer 150 from one end 156 to the other end 157 of microchannel layer 150. Microchannel layer 160 contains a plurality of first microchannels 162 arranged in parallel and extending along the length of microchannel layer 160 from end 164 to end 165, each microchannel 162 extending along the width of microchannel layer 160 from one end 166 to the other end 167 of microchannel layer 160.

Figure 3:
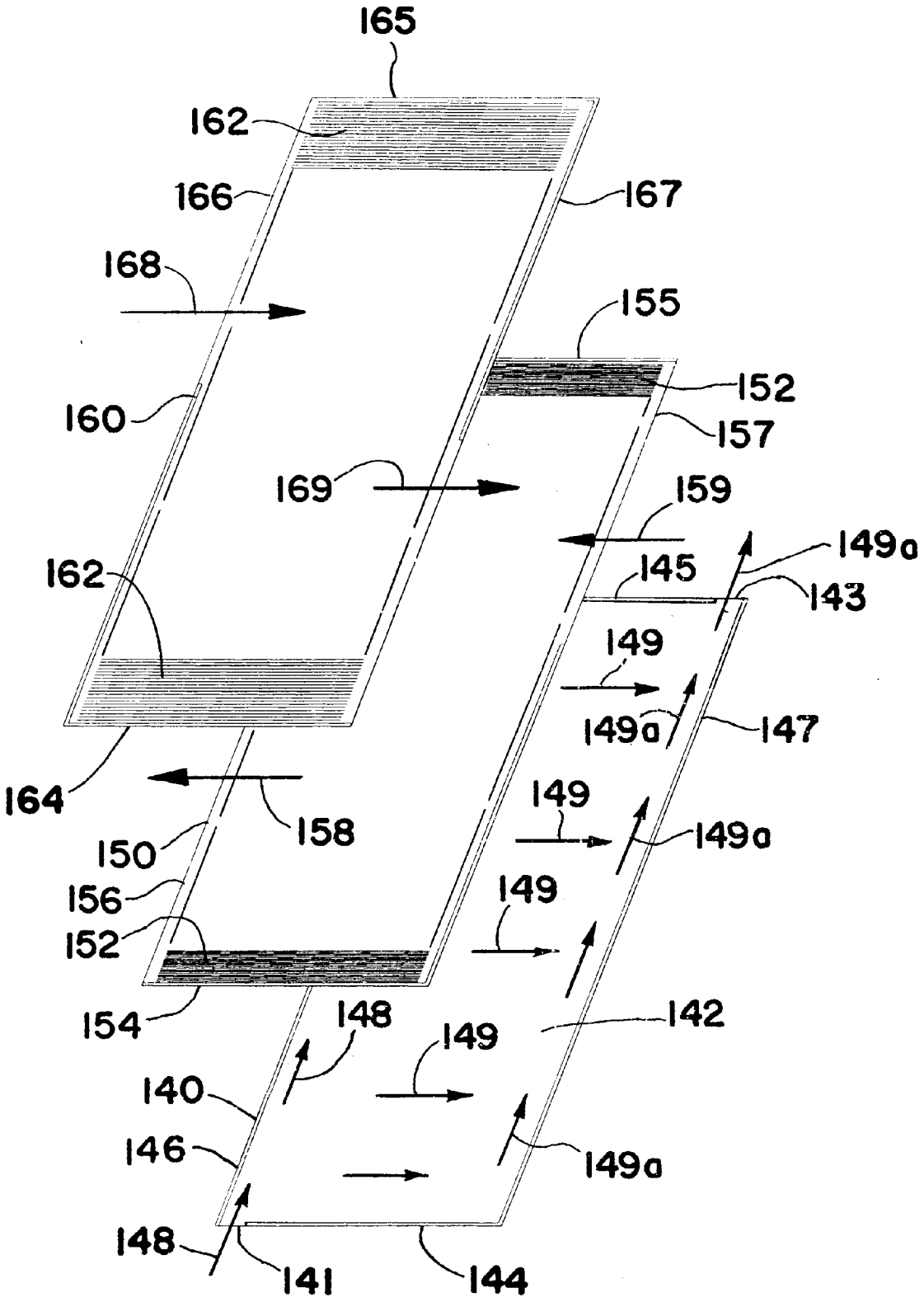
FIG. 3 is a schematic illustration showing an exploded view of microchannel layers used in one embodiment of a heat exchanger that may be employed with the inventive process with the direction of flow of refrigerant and gaseous product to be liquefied being indicated.

The flow of the refrigerant and product through the microchannels may be illustrated in part in FIG. 3. Referring to FIG. 3, high pressure refrigerant flows through microchannels 162 in microchannel layer 160 in the direction indicated by arrows 168 and 169. Low pressure refrigerant flows through microchannels 152 in microchannel layer 150 in the direction indicated by arrows 158 and 159. The flow of the high pressure refrigerant is countercurrent to the flow of the low pressure refrigerant. The product to be cooled or liquefied enters microchannel 142 through entrance 141 as indicated by arrows 148, flows through microchannel 142 as indicated by arrows 149, and exits microchannel 142 through exit 143 as indicated by arrows 149*a*. The product to be cooled or liquefied flows through microchannel 142 in a direction that is substantially counter current relative to the flow of the low pressure refrigerant through the microchannels 152 as indicated by arrows 149. The flow of high pressure refrigerant through microchannels 122 is in the same direction as the flow of high pressure refrigerant through microchannels 162. The flow of low pressure refrigerant through microchannels 112 and 132 is in the same direction as the flow of low pressure refrigerant through microchannels 152.

The number of microchannels in each of the microchannel layers 110,120, 130, 140, 150 and 160 may be any desired number, for example, two, three, four, five, six, eight, tens, hundreds, thousands, tens of thousands, hundreds of thousands, millions, etc. Similarly, the number of repeating units 100 of microchannel layers may be any desired number, for example, tens, hundreds, thousands, etc.

Referring to FIGS. 1 and 2, in heat exchanger 18 the high pressure refrigerant flows through a set of first microchannels corresponding to microchannels 122 and 162 and exits the heat exchanger through line 20. The flow of high pressure refrigerant through the set of first microchannels 122 and 162 may be non-turbulent, that is, it may be laminar or in transition, and in one embodiment it may be laminar. The refrigerant entering the set of first microchannels 122 and 162 is typically in the form of a mixture of vapor and liquid, while the refrigerant exiting these microchannels is typically in the form of a liquid. The Reynolds Number for the flow of vapor refrigerant through these microchannels may be up to about 4000, and in one embodiment up to about 3000, and in one embodiment up to about 1500, and in one embodiment about 20 to about 1300. The Reynolds Number for the flow of liquid refrigerant through these microchannels may be up to about 4000, and in one embodiment up to about 1500, and in one embodiment up to about 1000, and in one embodiment up to about 250, and in one embodiment about 30 to about 170. Each of the microchannels 122 and 162 in the set of first microchannels may have a cross section having any shape, for example, a square, rectangle or circle. Each of these microchannels 122 and 162may have an internal height or width of up to about 2 mm, and in one embodiment in the range of about 0.05 to about 2 mm, and in one embodiment about 0.2 to about 1 mm. The length of each of these microchannels may be up to about 6 meters, and in one embodiment from about 0.5 to about 6 meters, and in one embodiment about 0.5 to about 2 meters, and in one embodiment about 1 meter. The refrigerant exiting the set of first microchannels may be at a pressure of up to about 1000 psig, and in one embodiment about 200 to about 1000 psig, and in one embodiment about 300 to about 650 psig; and a temperature of about −120 to about −180° C., and in one embodiment about −140 to about −160° C. In one embodiment, the pressure is about 322.8 psig and the temperature is about −153.9° C. The total pressure drop for the flow of high pressure refrigerant through the set of first microchannels in heat exchanger 18 may be up to about 10 pounds per square inch (psi), and in one embodiment from about 0.1 to about 7 psi, and in one embodiment about 0.2 to about 5 psi.

The high pressure refrigerant exits the set of first microchannels through line and flows through expansion device 22. Expansion device 22 may be of any conventional design. The expansion device may be one or a series of expansion valves, one or a series of flash vessels, or a combination of the foregoing. The refrigerant exiting the expansion device 22 may be at a pressure of about 0 to about 100 psig, and in one embodiment about 0 to about 60 psig, and in one embodiment about 20 to about 40 psig; and a temperature of about −120 to about −180° C., and in one embodiment about −125 to about −170° C., and in one embodiment −150 to about −170° C. In one embodiment, the pressure is about 29.95 psig, and the temperature is about −158.3° C. At this point the refrigerant may be referred to as a low pressure refrigerant.

The low pressure refrigerant flows from expansion device 22 through line 24 back into heat exchanger 18. In heat exchanger 18 the low pressure refrigerant flows through a set of second microchannels corresponding to microchannels 112, 132 and 152 in FIG. 2 and exits the heat exchanger through line 26. The flow of refrigerant through the set of second microchannels 112, 132 and 152 may be non-turbulent, that is, it may be laminar or in transition, and in one embodiment it may be laminar. The refrigerant entering the second set of microchannels is typically in the form of a mixture of vapor and liquid, while the refrigerant exiting these microchannels is typically in the form of a vapor. The Reynolds Number for the flow of vapor refrigerant through these microchannels may be up to about 4000, and in one embodiment up to about 2000, and in one embodiment in the range of about 100 to about 2300, and in one embodiment about 200 to about 1800. The Reynolds Number for the flow of liquid refrigerant through these microchannels may be up to about 4000, and in one embodiment up to about 3000, and in one embodiment up to about 2000, and in one embodiment up to about 1000, and in one embodiment up to about 500, and in one embodiment up to about 250, and in one embodiment about 5 to about 100, and in one embodiment about 8 to about 36. Each of the microchannels 112, 132 and 152 in the second set of microchannels may have a cross section having any shape, for example, a square, rectangle or circle. Each microchannel may have an internal height or width of up to about 2 mm, and in one embodiment in the range of about 0.05 to about 2 mm, and in one embodiment about 0.2 to about 1 mm. The length of each microchannel may be up to about 6 meters, and in one embodiment from about 0.5 to about 6 meters, and in one embodiment about 0.5 to about 3 meters, and in one embodiment about 0.5 to about 2 meters, and in one embodiment about 1 meter. The refrigerant exiting the set of second microchannels may be at a pressure of up to about 100 psig, and in one embodiment about 0 to about 100 psig, and in one embodiment about 0 to about 60 psig, and in one embodiment about 20 to about 40 psig; and a temperature of about 0 to about 100° C., and in one embodiment 0 to about 50° C., and in one embodiment about 0 to about 40° C., and in one embodiment about 10 to about 30° C. In one embodiment, the pressure is about 27.75 psig and the temperature is about 20.9° C. The total pressure drop for the flow of low pressure refrigerant through the set of second microchannels in heat exchanger 18 may be up to about 10 psi, and in one embodiment from about 0.1 to about 7 psi, and in one embodiment from about 0.1 to about 5 psi.

The product to be cooled or liquefied flows through line 28 to heat exchanger 18 and then through the set of third microchannels corresponding to microchannel 142 in FIG. 2. In one embodiment, the product is pre-cooled prior to entering heat exchanger 18. The flow of product through the set of third microchannels may be laminar, in transition or turbulent. In one embodiment, the product entering the third set of microchannels comprises a gas, and the product exiting these microchannels comprises a liquid. The Reynolds Number for the flow of gaseous product through the set of third microchannels may be from about 2000 to about 30,000, and in one embodiment about 15,000 to about 25,000. The Reynolds Number for the flow of liquid product through the set of third microchannels may be from about 1000 to about 10,000, and in one embodiment about 1500 to about 3000. Each of the microchannels in the third set of microchannels may have a cross section having any shape, for example, a square, rectangle or circle. Each of these microchannels may have an internal height of up to about 2 mm, and in one embodiment in the range of about 0.05 to about 2 mm, and in one embodiment about 0.3 to about 0.7 mm. The width of each of these microchannels as measured from side 144 to side 145 in FIG. 2 may be from about 0.01 to about 3 meters, and in one embodiment about 1 to about 3 meters. The length of each microchannel in the set of third microchannels as measured from side 146 to side 147 in FIG. 2 may be up to about 6 meters, and in one embodiment from about 0.5 to about 6 meters, and in one embodiment about 0.5 to about 2 meters, and in one embodiment about 1 meter. The total pressure drop fort he flow of product through the set of third microchannels in heat exchanger 18 may be from about 0.5 to about 30 psi/ft, and in one embodiment from about 1 to about 10 psi/ft.

The product entering the set of third microchannels may be at a pressure of about 0 to about 800 psig, and in one embodiment about 200 to about 800 psig, and in one embodiment about 500to about 800 psig; and a temperature of about −40 to about 40° C, and in one embodiment −10 to about 35° C. In one embodiment, the product is natural gas and the pressure is about 635.3 psig and the temperature is about 32.2° C.

The product exiting the set of third microchannels downstream (or after exiting) valve 32 may be at a pressure of about 0 to about 800 psig, and in one embodiment about 0 to about 400 psig, and in one embodiment about 0 to about 150 psig, and in one embodiment about 0 to about 75 psig, and in one embodiment about 0 to about 20 psig, and in one embodiment about 2 to about 8 psig; and a temperature of −85 to about −170° C., and in one embodiment −110 to about −165° C.

In one embodiment, the product is liquefied natural gas, the pressure is about 5 psig, and the temperature is about −155.3° C.

The sets of first, second and third microchannels may be constructed of a material comprising a metal (e.g, stainless steel or other steel alloys), ceramics, polymer (e.g., a thermoset resin), or a combination thereof. These materials provide thermal conductivities that are sufficient to provide the necessary requirements for overall heat transfer coefficients. An advantage of using these materials is that inefficiencies due to axial conduction are significantly reduced as compared to using high thermal conductive materials such as aluminum. This permits the use of relatively short microchannels in the heat exchanger. Thus, although the microchannels may be constructed of a high thermal conductive material such as aluminum, an advantage of the inventive process is that it is not necessary to use such materials.

With the inventive process, it is possible to use large numbers of microchannels operating in parallel (to obtain relatively high surface areas) that are relatively short in length to minimize pressure drop. These microchannels may provide high heat transfer coefficients (since the Nusselt number is the same, but the hydraulic diameter is lower) and low pressure drops as compared to conventional cryogenic liquefication systems.

In one embodiment, the interstream planar heat transfer area percent (IPHTAP) for the heat exchanger 18 may be at least about 20%,and in one embodiment at least about 30%,and in one embodiment at least about 40%,and in one embodiment at least about 50%. IPHTAP refers to the percent of total heat exchanger surface area available through which heat is transferred to neighborning channels with a different fluid to the total surface area in the channel. IPHTAP relates to effective heat transfer and refers to the surface area that separates two fluids exchanging heat in a channel device excluding ribs, fins, and surface area enhancers as a percent of the total interior surface area of a channel that includes ribs, fins, and surface area enhancers. IPHTAP may be calculated using the formula $$IPHTAP = \frac{\text{Area on channel perimeter through which heat is transferred to different streams}}{\text{Total surface area in the channel}} \times 100$$

In one embodiment, the volumetric heat flux for the heat exchanger 18 is at least about 0.5 watts per cubic centimeter ($W/cm^3$), and in one embodiment at least about 0.75 $W/cm^3$, and in one embodiment at least about 1.0 $W/cm^3$, and in one embodiment at least about 1.2 $W/cm^3$, and in one embodiment at least about 1.5 $W/cm^3$. The term volumetric heat flux refers to the heat gained by the low pressure refrigerant flowing through the set of second microchannels divided by the core volume of the heat exchanger 18. The core volume of the heat exchanger includes all the streams of the heat exchanger 18 and all the structural material that separates the streams from each other, but does not include the structural material separating streams from the outside. Therefore, the core volume ends on the edge of the outermost streams in the heat exchanger. In addition, it does not include manifolding.

In one embodiment, the effectiveness of the heat exchanger 18 is at least about 0.98, and in one embodiment at least about 0.985, and in one embodiment at least about 0.99, and in one embodiment at least about 0.995, with the set of first microchannels and the set of second microchannels having lengths of up to about 3 meters, and in one embodiment up to about 2 meters, and in one embodiment up to about 1 meter. The effectiveness of a heat exchanger is a measure of the amount of heat that is transferred divided by the maximum amount of heat that can be transferred. The effectiveness of the heat exchanger 18 can be calculated form the formula $$\varepsilon = \frac{H_{ip} - H_{op}}{H_{ip} - H_{ilpr}}$$

wherein:

$\epsilon$ is the effectiveness of the heat exchanger;

$H_{ip}$ is the inlet enthalpy of the product to be cooled or liquefied;

$H_{op}$ is the outlet enthalpy of the product to be cooled or liquefied; and $H_{ilpr}$ is the enthalpy of the product at the low pressure refrigerant inlet temperature.

In one embodiment, the product to be cooled or liquefied is cooled from a temperature of about −40° C. to about 4020 C., and in one embodiment about −40° C. to about 32° C., to a temperature of about −140° C. to about −160° C., and in one embodiment about −140° C. to about −155° C., and the rate of flow of such product is at least about 1500 pounds of product per hour per cubic meter (lbs/hr/$m^3$) of the core volume of the heat exchanger 18, and in one embodiment at least about 2500 lbs/hr/$m^3$. The total pressure drop for the refrigerant through the set of first microchannels and the set of second microchannels in the heat exchanger 18 may be up to about 30 psi, and in one embodiment up to about 20 psi, and in one embodiment up to about 10 psi, and in one embodiment up to about 5 psi, and in one embodiment up to about 3 psi.

In one embodiment, the coefficient of performance fort he heat exchanger 18 is at least about 0.5and in one embodiment at least about 0.6and in one embodiment at least about 0.65and in one embodiment at least about 0.68. The coefficient of performance is the enthalpy change for the product flowing through the set of third microchannels divided by the compressor power required to make up for the pressure drop resulting from the flow of refrigerant through the sets of first and second microchannels.

The approach temperature for the heat exchanger 18 may be up to about 30° C., and in one embodiment up to about 20° C., and in one embodiment up to about 10° C., and in one embodiment up to about 5° C. The approach temperature may be defined as the difference between the temperature of the product to be cooled or liquefied exiting the heat exchanger and the temperature of the low pressure refrigerant entering the heat exchanger or the inlet temperature of the coldest refrigerant stream entering the heat exchanger.

The heat exchanger 18 described herein is a three-stream heat exchanger with two of the streams being for the refrigerant (i.e., high pressure refrigerant and low pressure refrigerant) and the third stream being for the product. It is possible, however, to add one or more additional streams to the heat exchanger. For example, one or more additional streams employing a refrigerant at a different pressure and/or temperature as compared to the refrigerant used in the sets of first and second microchannels may be employed. A refrigerant with a different composition may be used in the one or more additional streams. In one embodiment, the high pressure refrigerant is in the form of a mixture of liquid and vapor, and the liquid flows through the heat exchanger as one stream in one set of microchannels and the vapor flows through the heat exchanger as a separate stream in another set of microchannels. The one or more additional streams of refrigerant may flow through additional sets of microchannels in a manner similar to the flow of refrigerant through the sets of first and second microchannels.

EXAMPLE 1

A three stream heat exchanger is provided for the purpose of liquefying natural gas. Two of the streams involve the flow of a refrigerant through the heat exchanger, and the third stream involves the flow of the natural gas. One of the refrigerant streams is a high pressure refrigerant stream which is operated at a pressure of 323.3–322.8 psig, and the other refrigerant stream is a low pressure refrigerant stream which is operated at a pressure of 29.95–27.75 psig. The high pressure and low pressure refrigerant streams flow counter current to each other as illustrated in FIG. 3 The natural gas stream flows cross current to the refrigerant streams as illustrated in FIG. 3.

The heat exchanger is constructed of stainless steel (SS 304). It has a length of 1.00 meter, a width of 1.70 meters, and a stacking height of 2.85 meters. The core volume for the heat exchanger is 4.85 cubic meters. Repeating units of microchannel layers corresponding to repeating unit 100 in FIG. 2 are used. The number of repeating units 100 used is 220.

The high pressure refrigerant flows through a set of first microchannels corresponding to microchannels 122 and 162 in FIG. 2. The heat exchanger has a total of 51,480 first microchannels operating in parallel. Each of the first microchannels 122 and 162 has a cross sectional shape in the form of rectangle. Each microchannel 122 and 162 has a width of 0.56 inch (14.22 mm), a height of 0.018 inch (0.45 mm) and a length of 3.28 ft (1.00 meter). The high pressure refrigerant entering the set of first microchannels is in the form of a mixture of liquid and vapor, while the high pressure refrigerant exiting the set of first microchannels is in the form of a liquid. The Reynolds Number for the liquid refrigerant flowing through the set of first microchannels is 99.7. The Reynolds Number for the vapor refrigerant flowing through set of first microchannels is 649.

The low pressure refrigerant flows through a set of second microchannels corresponding to microchannels 112,132 and 152 in FIG. 2. The heat exchanger has a total of 155,100 second microchannels operating in parallel. Each of the microchannels 112, 132 and 152 has a cross sectional shape in the form of rectangle. Each microchannel has a width of 0.275 inch (6.99 mm), a height of 0.022 inch (0.59 mm) and a length of 3.28 feet (1.00 meter). The low pressure refrigerant entering the second microchannels is in the form of a mixture of liquid and vapor, while the low pressure refrigerant exiting the set of second microchannels is in the form of a vapor. The Reynolds Number for the liquid flowing through the set of second microchannels is 22. The Reynolds Number for the vapor flowing through set of second microchannels is 988.

The natural gas flows through a set of third microchannels corresponding to microchannel 142 in FIG. 2. The heat exchanger has 220 third microchannels operating in parallel. Each of the third microchannels has a cross sectional shape in the form of a rectangle. Each microchannel has a width of 9.35 feet (2.85 meters), a height of 0.016 inch (0.41 mm) and a length of 3.28 feet (1.0 meter). The natural gas is liquefied as it flows through the set of third microchannels. The Reynolds Number for the liquid flowing through the set of third microchannels is 2356. The Reynolds Number for the gas flowing through set of third microchannels is 20,291.

The refrigerant has the following composition (all percentages being mol %):

| | |
|---|---|
| Nitrogen | 10% |
| Methane | 24% |
| Ethylene | 28% |
| Propane | 16% |
| Isobutane | 5% |
| Isopentane | 17% |

The refrigerant is compressed in a compressor to a pressure of 331.3 psig and a temperature of 153° C. The compressed refrigerant flows to a condenser where the pressure is reduced to 323.3 psig and the temperature is reduced to 29.4° C. At this point the refrigerant is a high pressure refrigerant in the form of a mixture of vapor and liquid. The refrigerant flows from the condenser and then to and through the set of first microchannels 122 and 162 in the heat exchanger. The total pressure drop for the refrigerant as it flows through the set of first microchannels is 0.3 psi. The refrigerant leaving the set of first microchannels is at a pressure of 322.8 psig and a temperature of −153.9° C. The refrigerant then flows through an expansion valve where the pressure drops to 29.95 psig and the temperature drops to −158.3° C. At this point the refrigerant is a low pressure refrigerant. From the expansion valve the refrigerant flows through the set of second microchannels 112, 132 and 152 in the heat exchanger. The total pressure drop for the refrigerant as it flows through the set of second microchannels is between 0.2–2.0 psi. The refrigerant exiting the set of second microchannels is at a pressure of 27.75 psig and a temperature of 20.9° C. The refrigerant then flows from the set of second microchannels back to the compressor where the refrigeration cycle starts again.

Natural gas at a pressure of 635.3 psig and a temperature of 32.2° C. enters the set of third microchannels in the heat exchanger. The natural gas flows through the set of third microchannels and exits the microchannels in the form of a liquid. The flow rate of the natural gas is 15750 pounds per hour. The liquefied natural gas is at a pressure of 5 psig and a temperature of −155.3° C.

Figure 4:
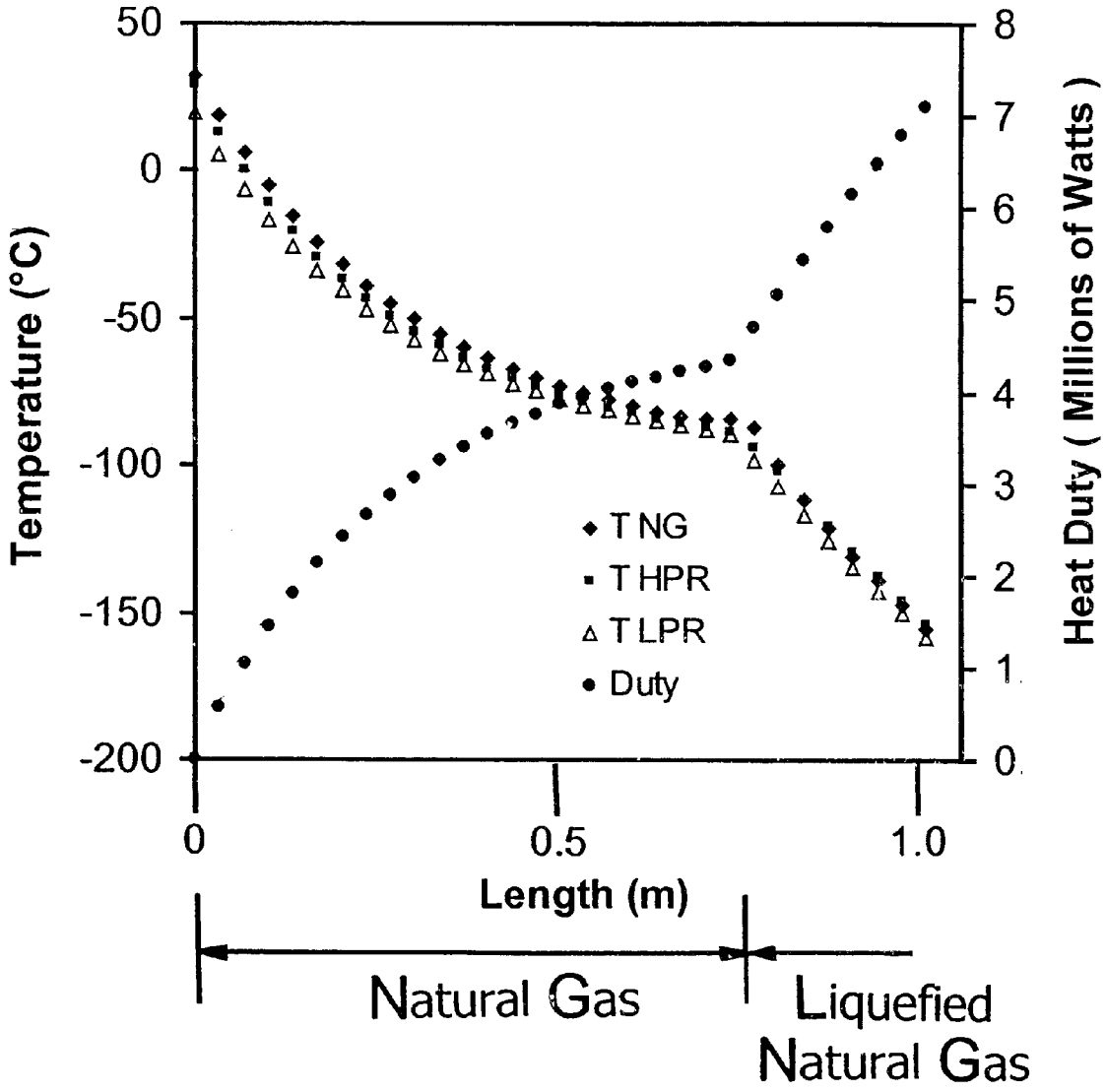
FIG. 4 is a plot showing the temperature of the three streams in the heat exchanger of Example 1 and the total heat transferred in the heat exchanger.

The volumetric heat flux for the heat exchanger is 1.5 $W/cm^3$. A plot of the temperature of the three streams in the heat exchanger and the total heat transferred in the heat exchanger is provided in FIG. 4. In FIG. 4, TNG refers to the temperature of the natural gas. THPR refers to the temperature of the high pressure refrigerant. TLPR refers to the temperature of the low pressure refrigerant.

While the invention has been explained in relation to various detailed embodiments, it is to be understood that various modifications thereof will become apparent to those skilled in the art upon reading the specification. Therefore, it is to be understood that the invention disclosed herein is intended to cover such modifications as fall within the scope of the appended claims.

What is claimed is:

1. A process for cooling a product in a heat exchanger, the process comprising:

flowing a refrigerant through a set of first microchannels in the heat exchanger;

flowing a refrigerant through a set of second microchannels in the heat exchanger, the refrigerant flowing through the set of second microchannels being at a lower temperature, a lower pressure, or both a lower temperature and a lower pressure than the refrigerant flowing through the set of first microchannels; and flowing a product through a set of third microchannels in the heat exchanger, the product exiting the set of third microchannels having a cooler temperature than the product entering the set of third microchannels.

2. The process of claim 1 wherein the flow of refrigerant through the set of first microchannels is non-turbulent.

3. The process of claim 1 wherein the flow of refrigerant through the set of second microchannels is non-turbulent.

4. The process of claim 1 wherein the refrigerant entering the set of first microchannels comprises a mixture of vapor and liquid, the Reynolds Number for the flow of vapor refrigerant through the set of first microchannels being up to about 4000, and the Reynolds Number for the flow of liquid refrigerant through the set of first microchannels being up to about 4000.

5. The process of claim 1 wherein the refrigerant entering the set of second microchannels comprises a mixture of vapor and liquid, the Reynolds Number for the flow of vapor refrigerant through the set of second microchannels being up to about 4000, and the Reynolds Number for the flow of liquid refrigerant through the set of second microchannels being up to about 4000.

6. The process of claim 1 wherein the refrigerant is compressed in a compressor and then partially condensed prior to flowing through the set of first microchannels.

7. The process of claim 1 wherein the refrigerant flows from the set of first microchannels through an expansion device to the set of second microchannels.

8. The process of claim 1 wherein the flow of refrigerant through the set of first microchannels is countercurrent to the flow of refrigerant through the set of second microchannels.

9. The process of claim 1 wherein the refrigerant entering the set of first microchannels is at a pressure of up to about 1000 psig and a temperature of about 0 to about 100° C.

10. The process of claim 1 wherein the refrigerant exiting the set of first microchannels is at a pressure of up to about 1000 psig and a temperature of about −120 to about −180° C.

11. The process of claim 1 wherein the refrigerant entering the set of second microchannels is at a pressure of up to about 100 psig and a temperature of about −120 to about −180° C.

12. The process of claim 1 wherein the refrigerant exiting the set of second microchannels is at a pressure of up to about 100 psig and a temperature of about 0 to about 100° C.

13. The process of claim 1 wherein the product entering the set of third microchannels is at a pressure of up to about 800 psig and a temperature of about −40 to about 40° C.

14. The process of claim 1 wherein the product exiting the set of third microchannels is at a pressure of up to about 800 psig, and a temperature of about −85 to about −170° C.

15. The process of claim 1 wherein the pressure drop for the refrigerant flowing through the set of first microchannels is up to about 10 pounds per square inch.

16. The process of claim 1 wherein the pressure drop for the refrigerant flowing through the set of second microchannels is up to about 10 pounds per square inch.

17. The process of claim 1 wherein the refrigerant comprises nitrogen, carbon dioxide, an organic compound containing 1 to about 5 carbon atoms per molecule, or a mixture of two or more thereof.

18. The process of claim 1 wherein the product comprises carbon dioxide, helium, nitrogen, argon, an organic compound containing 1 to about 5 carbon atoms per molecule, or a mixture of two or more thereof.

19. The process of claim 1 wherein the product entering the set of third microchannels comprises natural gas.

20. The process of claim 1 wherein the product exiting the set of third microchannels comprises liquefied natural gas.

21. The process of claim 1 wherein the sets of first microchannels, second microchannels and third microchannels are constructed of a material comprising metal, ceramics, plastic, or a combination thereof.

22. The process of claim 1 wherein each microchannel in the set of first microchannels has an internal dimension of width or height of up to about 2 mm.

23. The process of claim 1 wherein each microchannel in the set of second microchannels has an internal dimension of width or height of up to about 2 mm.

24. The process of claim 1 wherein each microchannel in the set of third microchannels has an internal dimension of width or height of up to about 2 mm.

25. The process of claim 1 wherein each microchannel in the set of first microchannels has a length of up to about 6 meters.

26. The process of claim 1 wherein each microchannel in the set of second microchannels has a length of up to about 6 meters.

27. The process of claim 1 wherein each microchannel in the set of third microchannels has a length of up to about 6 meters.

28. The process of claim 1 wherein the coefficient of performance for the heat exchanger is at least about 0.5.

29. The process of claim 1 wherein refrigerant flows through at least one additional set of microchannels in the heat exchanger.

30. The process of claim 1 wherein the interstream planar heat transfer area percent for the heat exchanger is at least about 20%.

31. The process of claim 1 wherein the volumetric heat flux for the heat exchanger is at least about 0.5 $W/cm^3$.

32. The process of claim 1 wherein the effectiveness of the heat exchanger is at least about 0.98, and the set of first microchannels and the set of second microchannels have lengths of up to about 3 meters.

33. The process of claim 1 wherein the product is cooled from a temperature of about 40° C. to a temperature of about −160° C., the rate of flow of product through the heat exchanger being at least about 1500 pounds per hour per cubic meter of the core volume of the heat exchanger.

34. The process of claim 33 wherein the total pressure drop for the flow of refrigerant through the set of first microchannels and through the set of second microchannels is up to about 30 psi.

35. The process of claim 34 wherein the approach temperature for the heat exchanger is up to about 30° C.

36. A process for cooling a product in a heat exchanger, the process comprising:

(A) compressing a gaseous refrigerant in a compressor;

(B) flowing the refrigerant through a set of first microchannels in the heat exchanger;

(C) reducing the temperature or pressure or both the temperature and pressure of the refrigerant;

(D) flowing the refrigerant through a set of second microchannels in the heat exchanger;

(E) returning the refrigerant to the compressor; and (F) flowing a product through a set of third microchannels in the heat exchanger, the product exiting the set of third microchannels having a cooler temperature than the product entering the set of third microchannels.

37. A process for liquefying natural gas, comprising:

(A) compressing a gaseous refrigerant in a compressor;

(B) flowing the refrigerant through a set of first microchannels in a heat exchanger;

(C) reducing the temperature or pressure or both the temperature and pressure of the refrigerant;

(D) flowing the refrigerant through a set of second microchannels in the heat exchanger;

(E) returning the refrigerant to the compressor; and (F) flowing natural gas through a set of third microchannels in the heat exchanger, the natural gas exiting the set of third microchannels in the form of a liquid.

* * * * *